United States Patent [19]

Hockett

[11] 4,126,970

[45] Nov. 28, 1978

[54] ABRASIVE CLEANING APPARATUS

[76] Inventor: Wayne B. Hockett, 1701 E. Sligh Ave., Tampa, Fla. 33605

[21] Appl. No.: 746,492

[22] Filed: Dec. 1, 1976

Related U.S. Application Data

[63] Continuation-in-part of Ser. No. 614,191, Sep. 17, 1975, Pat. No. 4,027,433.

[51] Int. Cl.[2] ..... B24C 3/06

[52] U.S. Cl. ..... 51/429; 239/255

[58] Field of Search ..... 51/8 R, 8 HD, 427, 429; 239/176, 192, 450, 536, 587, 255, 261

[56] References Cited

U.S. PATENT DOCUMENTS

| | | | |
|---|---|---|---|
| 1,230,458 | 6/1917 | Bovery | 239/587 X |
| 2,836,013 | 5/1958 | Koenig | 51/8 HD |
| 3,074,649 | 1/1963 | Atkinson | 239/587 X |
| 3,149,438 | 9/1964 | Morley | 51/427 |
| 3,604,627 | 9/1971 | Miscovich | 239/587 X |

FOREIGN PATENT DOCUMENTS

| | | | |
|---|---|---|---|
| 733,188 | 3/1943 | German Democratic Rep. | 239/255 |

*Primary Examiner*—Gary L. Smith

*Attorney, Agent, or Firm*—Stein & Frijouf

[57] ABSTRACT

An abrasive cleaning apparatus configured for use in combination with a mobile chassis comprising a base to fasten the abrasive cleaning apparatus to the mobile chassis, an adjustable nozzle support to operatively support a plurality of nozzles thereon and interconnecting support coupled between the base and adjustable nozzle support. The interconnecting support includes a base plate and a support member fixedly attached to the nozzle support and rotatably attached to the base plate so that the nozzle support is rotatable about the vertical axis of the support member. The adjustable nozzle support includes a rotatable support shaft fixedly attached to a nozzle holder at one end thereof and a yoke at the opposite end thereof so that the nozzles of the abrasive cleaning apparatus can be positioned horizontally relative to the work surface. The abrasive cleaning apparatus further comprises at least one vertical riser attachment to adjustably attach the interconnecting support to the vertical riser at various points thereon to adjust the nozzles vertically relative to the work surface. Further the nozzle holder is adjustably attached to the support shaft for angular adjustment of the nozzles relative to the work surface.

6 Claims, 3 Drawing Figures

ABRASIVE CLEANING APPARATUS

CROSS-REFERENCE TO RELATED APPLICATION

This is a continuation-in-part of application Ser. No. 614,191, filed Sept. 17, 1975, now U.S. Pat. No. 4,027,433.

BACKGROUND OF THE INVENTION

1. Field of the Invention

An abrasive cleaning apparatus including an adjustable nozzle support means having a horizontal positioning means to permit movement of a plurality of nozzles in a plane parallel to a work surface and a vertical and angular adjustment means to adjust the vertical position and angle of the plurality of nozzles relative to the work surface.

2. Description of the Prior Art

Sand blasting of surfaces cleaned preparatory to painting and simply cleaning in the case of stone or brick walls is a common practice. Generally, this is accomplished by an operator positioned on a scaffold or other suitable support manually manipulates at least one discharge nozzle. Obviously, the presence of the operator in the work zone makes this an extremely dirty and hazardous occupation. Moreover, the limited volume of sand blasted against the surface by a single nozzle is very inefficient.

As a result, abrasive blast apparatus, particularly used for large surface areas, may employ multiple rather than a single blast nozzle. The obvious advantage of this being a greatly increased blast pattern. Due to the increased weight and speed of operation, those nozzles are often mounted on movable carriages or platforms on which the operator rides. The platform is movable laterally and vertically along the area to be cleaned and results in significant labor saving devices.

Unfortunately, a number of difficulties have been experienced which hindered general acceptance and wide use for the multi-nozzle head. For example, many multi-nozzle heads are of a type in which the sand and air are delivered and mixed in a common reservoir from which jet streams are propelled simultaneously from the nozzles all of which communicate directly with the reservoir. In another configuration, the operator may be provided with two separate nozzles each having its own supply lines. In either of these arrangements, individual control of the nozzles is lacking to the extent that the blast stream in one nozzle cannot be cut off independently of the other. Such independent manipulations of the blast from the different nozzles is desirable in situations involving spots or areas which present difficult cleaning problems. The blast from one nozzle must work on this different area for a prolonged period, during which time and other blasts will be cutting away injuriously at the clean metal or surrounding areas.

Another difficulty with previous multi-blast carriage arrangements is that the units are very cumbersome and complex so as to be suitable only for special cleaning operations. Also many such multiple nozzle machines have lacked adequate flexibility of movement and could not be easily manipulated.

More unique problems exist with respect to the development of such apparatus for cleaning the undersides of ships in dry dock where there is very little clearance between the hull and the floor of the dry dock. Bulky machines cannot reach into that area. After such an apparatus is placed under the hull, it must be constructed so as to position a plurality of nozzles so as to efficiently clean the under surfaces of the ship.

Thus, there is a clear need for an efficient, flexible and easily moved multiple nozzle blasting apparatus for cleaning the undersides of ships in dry docks.

SUMMARY OF THE INVENTION

This invention relates to an abrasive cleaning apparatus configured for use with a mobile platform or chassis such as a golf cart or the like for cleaning surfaces in locations such as the undersides and docks of ships in dry dock. More specifically, the abrasive cleaning apparatus comprises a base means to mount the apparatus on a moble chassis, an adjustable nozzle support means to operatively support a plurality of nozzles thereon and an interconnecting support means to operatively couple the base means and the ajdustable nozzle support means.

The base means comprises a base plate including an attachment means to attach the abrasive cleaning apparatus to the mobile chassis. The base means further comprises a pair of vertical risers fixedly attached at the lower portions thereof to the base plate.

The interconnecting support means comprises a support plate, a pair of riser attachment means which adjustably attach the support plate to the pair of vertical risers at any desired height on the vertical risers, and at least one support member fixedly attached at the upper portion thereof to the adjustable nozzle support means. An attachment shaft rotatably attached the support plate to the base means to permit horizontal rotation of the adjustable nozzle support means and interconnecting means about the vertical axis of the attachment shaft. The vertical risers and the riser attachment means cooperatively form a vertical adjustment means to permit vertical adjustment of the plurality of nozzles relative to the work surface.

The adjustable nozzle support means comprises a rotatable support shaft with a rotation means fixedly attached to one end thereof and a nozzle holder fixedly attached at the opposite end thereof. The support shaft is rotatably supported by at least one bearing means fixedly attached to the support member of the interconnecting support means. The nozzle holder comprises a pair of bars having a nozzle collar having a plurality of apertures formed therein to operatively support a corresponding plurality of nozzles disposed in a generally upward direction. The nozzle collar is pivotally coupled to the bars to permit angular adjustment of the nozzles relative to the work surface.

In operation, abrasive must leave the tips of the nozzles with sufficient force to clean the work surface. For this force, there is an equal force acting in the opposite direction. The horizontal component perpendicular to the support shaft of this force tends to rotate the nozzle support means. The magnitude of that component of force varies from zero to a large component of the total force depending upon the angular position of the nozzles. That angular position is varied by rotating the support shaft by means of the rotating means.

The vertical risers serve to limit the horizontal movement of the adjustable nozzle support means on either side by engagement therewith so that the adjustable nozzle support means to limit the horizontal movement thereof. The support shaft, rotation means, vertical risers, and the previously described component of force cooperatively form a horizontal positioning means for the positioning of the nozzles in a plane substantially parallel to the work surface.

To operate, the operator sits on the platform adjacent the rotation means of the adjustable nozzle support means. As can be readily understood the plurality of nozzle means is coupled to a remote supply source through a conduit means. For example, the remote supply source may comprise a sand hopper which also incorporates an appropriate compressed air supply to forcefully transport and drive the abrasive from the nozzles. In a manner which will be understood, a supply of compressed air is directed along with the sand into flexible sand conduits for transporting the sand through these conduits. In addition, compressed air may also be directed into flexible air conduits. The separate supply of air under pressure eventually being directed into a mixing reservoir within the blast nozzles to and against the work. The manner in which the air and sand is mixed in the nozzle is of no particular concern. The nozzle structure of the present mechanism itself can be of any aopropriate conventional configuration.

To adjust the abrasive cleaning apparatus prior to cleaning, the height of the adjustable nozzle support means is adjusted by means of the vertical positioning means until the plurality of nozzles are positioned at the most efficient height relative to the work surface. Then the operator adjusts the angular adjustment means so as to obtain the most efficient angular bearing of the nozzles relative to the particular curvature of the work surface. The operator then positions the abrasive cleaning apparatus by means of the mobile chassis and begins cleaning. During cleaning, the nozzles are positioned horizontally along the work surface by the operator merely turning the rotating means as necessary. The mobile chassis is then moved to an adjacent work surface until the entire area is cleaned.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and the objects of the invention, reference should be had to the following detailed description taken in connection with the accmpanying drawings in which.

Similar reference characters refer to similar parts throughout the several views of the drawings.

DETAILED DESCRIPTION OF THE PREFERRED EMBODIMENT

Figure 1:
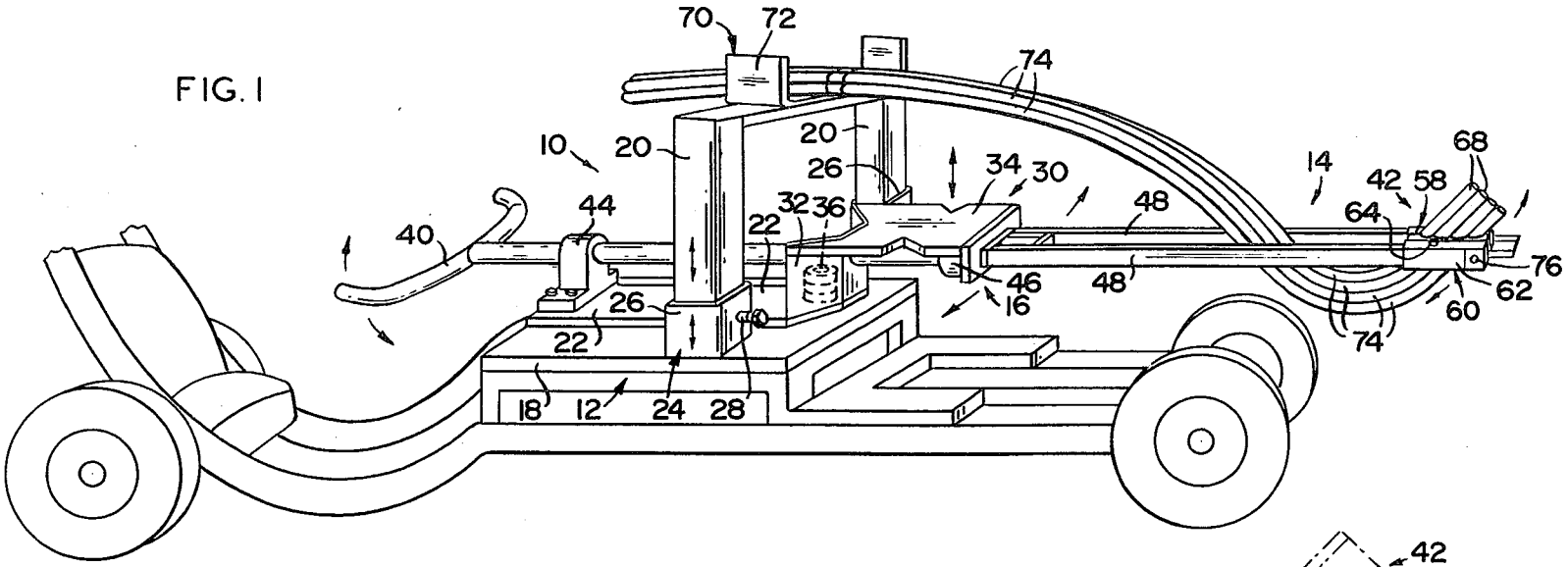
FIG. 1 is a perspective view of the abrasive cleaning apparatus.
Figure 3:
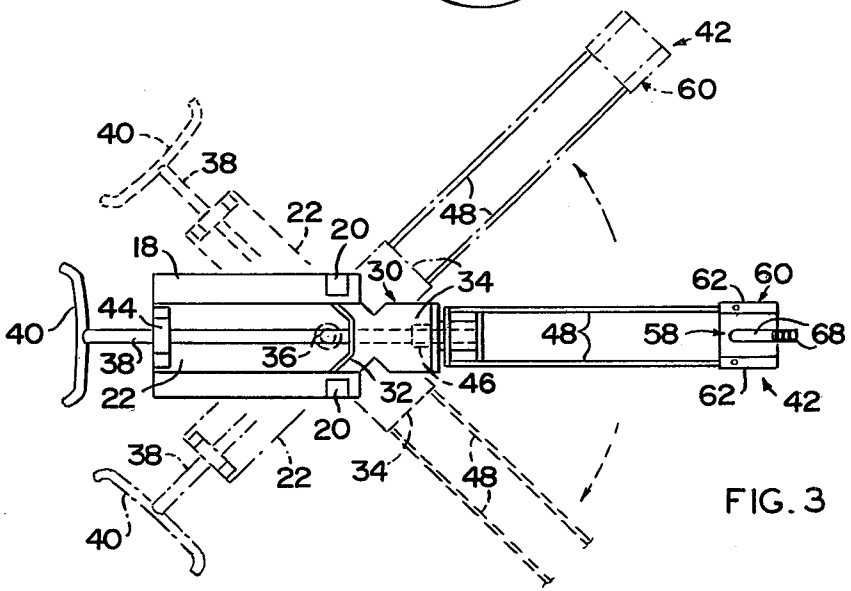
FIG. 3 is a partial top view of the apparatus of FIG. 1 with the hoses and hose supports removed to more clearly show the elements below them.
Figure 2:
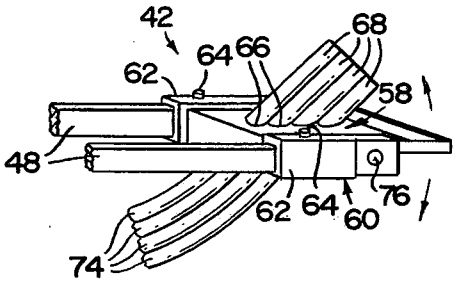
FIG. 2 is a detail view of the nozzle holder.

As best shown in FIG. 1, the present invention comprises an abrasive cleaning apparatus generally indicated as 10 for cleaning large work surfaces. In particular, the abrasive cleaning apparatus 10 is exceptionally useful for cleaning the undersides and decks of ships in dry dock by the positioning of a plurality of nozzles in operative communication therewith. The abrasive cleaning apparatus 10 comprises a base means 12, an adjustable nozzle support means 14, and an interconnecting support means 16 adjustably attached at one end thereof to the base means 12 and fixedly attached at the opposite end thereof to the adjustable nozzle support means 14.

The base means 12 comprises a base plate 18 to attach the abrasive cleaning apparatus 10 to the platform of a mobile chassis such as a golf cart or forklift or the like. The base means 12 includes a pair of vertical risers 20 which are substantially parallel members fixedly attached at the lower portions thereof to the base plate 18. Since the height between the hull of a ship and the floor of a dry dock is sometimes no more than three or four feet, the combined height of the mobile chassis and the vertical risers 20 must be small enough so the abrasive cleaning apparatus 10 can be maneuvered under a ship for cleaning purposes.

The interconnecting support means 16 comprises a substantially flat support plate 22 and a pair of riser attachment means 24 which adjustably and fixedly attach the support plate 22 to the pair of vertical risers 20. Each riser attachment means 24 comprises a collar 26 fixedly attached to the support plate 22 and a bolt 28 or other attachment means to fixedly attach the collar 26 to the vertical riser 20. Thus, the height of the nozzle support means 14 can be adjusted by attaching the collars 26 to the pair of vertical risers 20 at the desired height. The vertical risers 20 and the riser attachment means 24 cooperatively comprise a vertical adjustment means.

The interconnecting support means 16 further comprises at least one support member 30 including a first vertical element 32 attached to support plate 22 and a second horizontal element 34. An attachment shaft 36 is rotatably coupled to the support plate 22 by means of a bearing (not shown) to the base means 12 to permit horizontal rotation of the adjustable nozzle support means 14 about the vertical axis of the attachment shaft 36 as more fully described hereinafter.

The adjustable nozzle support means 14 comprises a rotatable support shaft 38 with a rotation means 40 such as a wheel or yoke fixedly attached at one end thereof and a nozzle holder 42 fixedly attached at the opposite end thereof. A first and second bearing means 44 and 46 respectively are attached to the base means 12 and horizontal element 34 respectively to operatively support the support shaft 38.

The nozzle holder 42 comprises a pair of substantially parallel support members 48 fixedly attached to the support shaft 38, a nozzle collar 58 pivotally attached to a pair of substantially parallel attachment means 60. Each attachment means 60 comprises an attachment member 62 detachably attached to the outer portion of one of the support members 48 by fastening means 64.

In an alternative embodiment, the nozzle holder 42 comprises the nozzle collar 58 as described, the nozzle collar 58 may be directly attached to the support shaft 38.

The nozzle collar 58 has a plurality of apertures 66 formed therein which operatively support a plurality of nozzles 68 disposed in a generally upward direction. A conduit plate 70 having a U-shaped conduit retainer 72 formed thereon is attached to risers 20 to operatively support a plurality of conduit means 74 corresponding to the plurality of nozzles 68.

The plurality of nozzles 68 is coupled to a remote supply source through the conduit means 74 such as hoses. For example, the remote supply source may comprise a sand hopper which also incorporates an appropriate compressed air supply to forcefully transport and drive the abrasive from the nozzles. In a manner which will be understood, a supply of compressed air is directed along with the sand into flexible sand conduits for transporting the sand through these conduits 74. In addition, compressed air may also be directed into flexible air conduits. This separate supply of air under pressure eventually being directed into a mixing reservoir within the blast nozzles 68 to and against the work surface. The manner in which the air and sand is mixed in the nozzle is of no particular concern. The nozzle structure 68 of the present mechanism itself can be of any appropriate conventional configuration.

As is readily understood, the sand or abrasive must leave the tips of the nozzles 68 with sufficient force to clean the work surface. For this force, there is an equal force acting in the opposite direction. This equal and opposite force, commonly referred to as jet action, has a vertical vector or component, a horizontal vector or component parallel to the support shaft 38, and a horizontal vector or component perpendicular to the support shaft 38, acting on the nozzle support means 14. As previously described, the nozzle support means 14 is rotatable in a horizontal plane about the axis of the attachment shaft 36. Therefore, the horizontal component perpendicular to the support shaft 38 of the force will tend to rotate the nozzle support means 14 horizontally. When the nozzles 68 are positioned so that the horizontal component perpendicular to the support shaft 38 is zero, then the nozzle support means 14 is not being rotated thereby about the axis of the attachment shaft 36.

The horizontal component of the force perpendicular to the support shaft 38 can be varied from zero to a large component of the total force and thus the velocity of rotation of the nozzle support means 14 can be varied, merely by means of an operator rotating the rotation means 40 and thus rotating the support shaft 38. Thus, neither brute strength nor elaborate electrical or other drive means but merely the jet action of the nozzles 68 is needed to position the nozzles 68 horizontally.

In addition to comprising part of the vertical adjustment means, the vertical risers 20 also serve to limit the horizontal movement of the nozzle support means 14 on either side by the engagement therewith.

The support shaft 38, rotation means 40 and the jet action effect cooperatively comprise a horizontal positioning means for the positioning of the nozzles 68 in a plane substantially parallel to the work surface. The vertical adjustment means is used to adjust the height of the nozzles 68 prior to beginning a cleaning operation to account for various heights of the hulls of various ships from the floor of a dry dock or otherwise.

As previously described the nozzle collar 58 is pivotally attached to the pair of parallel support members 48 on shaft 76. This comprises an angular adjustment means to adjust the angle of the blast striking the work surface so that that angle is as close to perpendicular as practical. This makes it possible to use the abrasive cleaning apparatus to clean surfaces of curvature of ship bottoms as well as flat areas with a high degree of efficiency.

The operator prepares to clean the undersurface of a ship in dry dock by adjusting the height of the nozzle support means 14 so as to position the nozzles 68 from the work surface at the most efficient distance for cleaning by moving the pair of vertical risers 20 to the desired height. Next, the operator adjusts the angular adjustment means and fixedly fastening the nozzle collar 58 to the pair of attachment means 60 at that point so as to obtain the most efficient angular bearing of the nozzles 68 relative to the particular curvature of the work surface. Next, the operator positions the abrasive cleaning apparatus 10 by means of the mobile chassis and begins cleaning. The nozzles 68 are then positioned horizontally along the work surface by the operator merely turning the rotating means 40 as is necessary. The mobile chassis is then moved to an adjacent work surface until the entire area is cleaned.

In this manner, an efficient, reliable sand blasting apparatus for the undersurfaces of ships and the like is provided.

It will thus be seen that the objects set forth above among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An apparatus for cleaning surfaces by blasting them with abrasives under fluid pressure, comprising a base, a plural nozzle support to operatively support a plurality of nozzles in parallel array relative to a work surface, a plurality of conduits leading from a remote supply source of abrasive and of fluid, a rotatable interconnecting support means for said nozzle support mounted on said base, positioning means to position said plurality of nozzles with respect to the work surface; said interconnecting support means including a support plate rotatably mounted on said base whereby said interconnecting support is rotatable in a horizontal plane, said plural nozzle support being supported on said support plate and comprising at least one support member fixedly attached to a rotatable support shaft, a yoke extending rearwardly from said support shaft for rotation of said support shaft and a nozzle holder attached to the forward end of said support member, said nozzle holder comprising a nozzle collar having a plurality of apertures therein for said plurality of nozzles, whereby rotation of said support shaft directs the opposing horizontal force vector of said plurality of nozzles during operation thereof to cause horizontal rotation of said interconnecting support, the degree of force of rotation of said support being adjustable by varying the angle of the plurality of nozzles.

2. The apparatus of claim 1 wherein said support plate is mounted on a vertical shaft extending from said base.

3. The apparatus of claim 1 further comprising a support for said conduits and a vertical adjustment means for said support.

4. The abrasive cleaning apparatus of claim 1 further comprising an angular adjustment means for said nozzle holder to enable adjustment of the angle of said plurality of nozzles relative to the work surface.

5. An apparatus for cleaning a work surface by blasting the surface with an abrasive under fluid pressure from a remote source of abrasive and fluid, comprising in combination:

a base;

a plurality of nozzles;

a nozzle support for supporting said nozzles in an array;

conduit means connecting said plurality of nozzles to the remote source of abrasive and fluid;

means for rotatably mounting said nozzle support to said base about a first axis of rotation;

means for rotatably mounting said nozzle support about a second axis of rotation for controlling the reaction force produced by said plurality of nozzles during operation; and means establishing said first axis to form an angle relative to said second axis such that rotation of said nozzles in a first direction about said second axis directs the reaction force of said plurality of nozzles during operation thereof to cause a first rotation of said nozzles about said first axis and rotation of said nozzles in a second direction about said second axis directs the reaction force of said plurality of nozzles during operation thereof to cause a second rotation of said nozzles about said first axis whereby alternate rotation about said second axis produces alternating sweeping across the work surface.

6. An apparatus for cleaning a work surface by blasting the surface with an abrasive under fluid pressure from a remote source of abrasive and fluid, comprising in combination:

a base;

at least one nozzle;

a nozzle support for supporting said nozzle;

conduit means connecting said nozzle to the remote source of abrasive and fluid;

means for rotatably mounting said nozzle support to said base about a first axis of rotation;

means for rotatably mounting said nozzle support about a second axis of rotation for controlling the reaction force produced by said nozzle during operation; and means establishing said first axis to form an angle relative to said second axis such that rotation of said nozzle in a first direction about said second axis directs the reaction force of said nozzle during operation thereof to cause a first rotation of said nozzle about said first axis and rotation of said nozzle in a second direction about said second axis directs the reaction force of said nozzle during operation thereof to cause a second rotation of said nozzle about said first axis whereby alternate rotation about said second axis produces alternating sweeping across the work surface.

* * * * *